US007503289B2

(12) United States Patent
Spoto et al.

(10) Patent No.: US 7,503,289 B2
(45) Date of Patent: Mar. 17, 2009

(54) ENHANCED RADIANT HEAT EXCHANGER APPARATUS

(75) Inventors: Maurizio Spoto, Cassina de' Pecchi (IT); Benedetto Spoto, Cassina de' Pecchi (IT)

(73) Assignee: Pycos Engineering Ltd, Tortola (VG)

( * ) Notice: Subject to any disclaimer, the term of this patent is extended or adjusted under 35 U.S.C. 154(b) by 0 days.

(21) Appl. No.: 10/572,013

(22) PCT Filed: May 5, 2004

(86) PCT No.: PCT/EP2004/004756

§ 371 (c)(1),
(2), (4) Date: Jan. 10, 2007

(87) PCT Pub. No.: WO2005/068926

PCT Pub. Date: Jul. 28, 2005

(65) Prior Publication Data

US 2007/0160514 A1 Jul. 12, 2007

(30) Foreign Application Priority Data

Jan. 15, 2004 (IT) ..... MI2004A0040

(51) Int. Cl.
*F22B 9/12* (2006.01)

(52) U.S. Cl. ..... 122/91; 122/58 FB; 122/368

(58) Field of Classification Search ..... 122/8, 122/50, 58 R, 58 FB, 72, 91, 213, 225 A, 122/367.1, 368; 422/198, 200, 202, 205
See application file for complete search history.

(56) References Cited

U.S. PATENT DOCUMENTS 3,921,711 A 11/1975 Westbrock
4,342,642 A 8/1982 Bauer et al.
4,351,392 A 9/1982 Stockman
4,479,534 A 10/1984 Rhodes
4,559,998 A * 12/1985 Counterman ..... 165/109.1
5,656,150 A * 8/1997 Reed et al. ..... 208/48 R
5,763,724 A 6/1998 Bellet et al.
6,484,795 B1 * 11/2002 Kasprzyk ..... 165/109.1
6,528,027 B1 * 3/2003 Brewer et al. ..... 422/200
7,004,085 B2 * 2/2006 Platvoet et al. ..... 110/203
2003/0209469 A1 * 11/2003 Kivlen ..... 208/132
2005/0019202 A1 * 1/2005 Lundberg et al. ..... 420/63

FOREIGN PATENT DOCUMENTS

CH 86913 1/1920
DE 3045731 A1 4/1980
DE 3211133 10/1983
DE 3702963 8/1988

(Continued)

*Primary Examiner*—Gregory A Wilson
(74) *Attorney, Agent, or Firm*—Greer Burns & Crain, Ltd

(57) ABSTRACT

An enhanced heat exchanger (10) consists of a tube (11) receiving heat from an external source. A fluid (F) to be heated flows through the free area created between the body (12, 12'), introduced inside the tube (11), and the tube itself. Both the tube (11) and the body (12, 12') heat the fluid (F). The body transfers to the fluid the energy received by the tube (11) by all the lo three modes of heat transfer: conduction, convection and radiation.

12 Claims, 3 Drawing Sheets

FOREIGN PATENT DOCUMENTS

Figure 1:
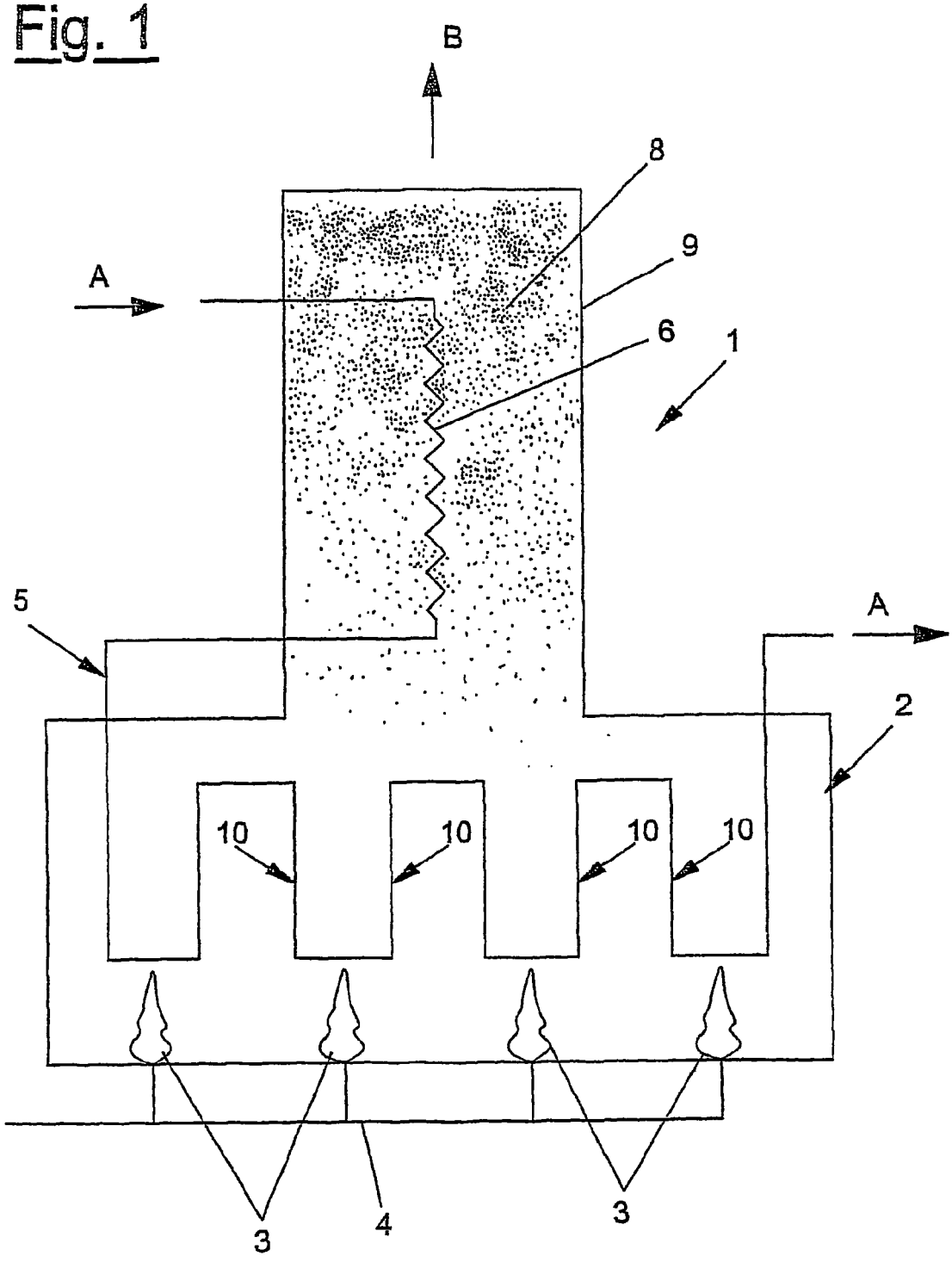

| | | |
|---|---|---|
| FR | 2688797 | 9/1993 |
| FR | 2760465 | 9/1998 |
| GB | 813565 | 5/1959 |
| SU | RU 19067 | 1/1967 |
| WO | 9856872 | 12/1998 |

* cited by examiner

ENHANCED RADIANT HEAT EXCHANGER APPARATUS

BACKGROUND OF THE INVENTION

1. Field of the Invention

The present invention relates to an enhanced heat exchanger apparatus. The present invention relates also to a heat exchanger formed by several such enhanced heat exchanger apparatuses. It relates further to a method of improving a heat transfer.

A particular application of the invention is the introduction of several enhanced heat exchanger apparatuses inside the radiant coil of a steam cracking furnace.

2. Description of the Prior Art

The three modes of heat transfer are conduction, convection and radiation.

In the classical heat exchangers, the heat is transferred from the hot fluid to the cold fluid through a tube wall essentially by two mechanisms: convection and conduction.

The heat transfer rate is a function of the heat surface, the heat transfer coefficient and the temperature difference between the tube wall and the fluid to be heated (cooled).

At present, technical solutions to improve the heat transfer are the use of finned tubes to increase the heat transfer surface or working in a wall developed turbulent fluid flow regime.

In case of heat exchangers operating at high temperature, for example >400° C., and in particular in the radiant coil of the process furnaces for the steam cracking of the hydrocarbons (where the tube wall temperature may reach a value as high as 1150° C. or even more), additional process needs arise.

In a ethylene plant it is fundamental to operate the steam cracking furnaces at conversion and selectivity as high as possible.

High selectivity means to increase the percentage of the more valuable products such as ethylene, propylene, butadiene at the expense of less valuable products (methane, fuel oil, etc.).

High selectivity is achieved if the residence time is low and the temperature of the process gas is high enough to have a good conversion of the feed.

The above goals are achieved by increasing the heat flux (by consequence, the temperature of the metal reaches a value close to its metallurgical constraint).

A higher temperature of the metal leads to undesired events:

High rates of deposit of coke, creep and carburization.

Also in those particular cases, the technology is oriented towards the improvement of the heat transfer coefficient using tubes with inside fins of various shapes (transverse, longitudinal, or with particular angles).

The inconvenience of the use of extended surfaces is the high cost of manufacturing and the difficulty to apply fins inside the radiant coil of existing ethylene cracking furnaces.

Sometimes internal protrusions in the cracking tube may be the cause of coking due to stagnation of feed gas, which leads to over cracking.

The above technique is focused on improving the heat transfer by the convection mechanism.

SUMMARY OF THE INVENTION

Applicant has recognized that the heat transfer can be considerably enhanced by the third mechanism: the radiative heat transfer.

In particular, when the process requires high temperatures, for example >400° C., the radiative heat transfer plays an important role because it is proportional to the fourth power of the absolute temperature of the body. This is known as the Stefan-Bolzmann law.

In other words, the exchange of energy between two surfaces of different temperatures is proportional to the difference of the fourth power of the absolute temperatures of the two bodies.

In the steam cracking furnaces, the temperature of the metal is in the range of 900° C. and 1175° C., while the temperature of process gas falls between 600° C. and 900° C.

At these operating conditions, the radiative heat transfer should reach a significant value but, in practice, in the radiant coil of the existing furnaces, the radiative heat transfer does not occur for the following reasons:

1. The tube, for geometrical reasons, radiates on to itself and, therefore, the net exchange of radiative energy is negligible.

2. The radiative heat absorbed by gas being cracked is negligible because the density of the gas is too small.

An object of the present invention is to provide a heat exchanger apparatus able to increase the convective heat transfer coefficient, the heat exchange area and, above all, the heat transfer rate due to the contribution of the radiative mechanism.

A further object of the present invention is to provide a enhanced heat exchanger apparatus to be used in all kinds of furnaces, but in particular, in the ethylene cracking furnaces. Still a further object is to provide a method to improve the heat transfer rate.

The advantage of the use of the enhanced radiant heat exchanger (ERHE) apparatus according to the present invention, is that it allows an ethylene cracking furnace to dramatically increase the heat exchange, while keeping the tube wall temperature on the external tube low.

Besides the longer run length of the furnace, due to the reduced coking rate, a higher selectivity (i.e. higher ethylene and propylene yields compared with bare tubes) can be expected.

Maintenance costs will be also reduced because the decoking interval increases.

Creep and carburization rates, related to the TMT and deposit of coke, shall be minimized to the advantage economy of the production.

These and other scopes and advantages, covered by the present invention, may be achieved using the proposed ERHE as explained in the claim No 1.

Additional characteristics and details of the present invention are the object of further claims depending from it.

A method to improve the heat transfer between a tube and the fluid flowing inside the tube itself, and in particular in the radiant coil of the steam cracking furnace, is the object of the claim No 11. The ERHE, covered by the present invention, includes a tube heated by an external source.

This tube is equipped inside with at least one body that receives energy by radiation from the enclosing tube and transfers it by convection to the process gas flowing in the annulus.

Figure 2A:
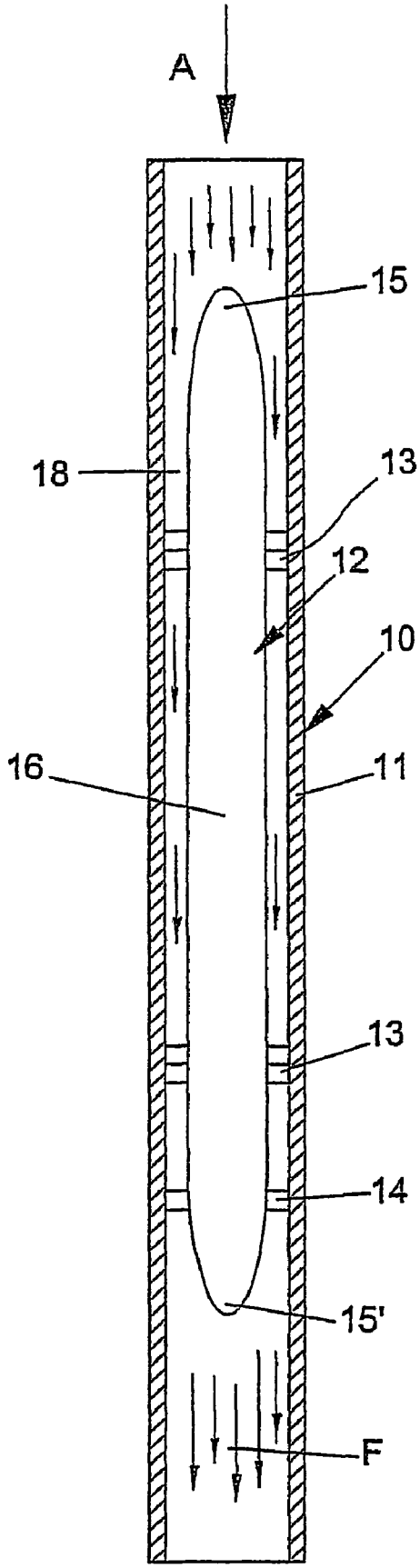
Figure 2B:
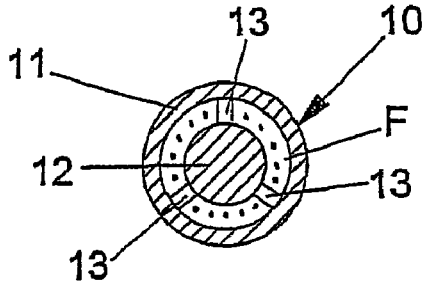

The present invention will be more fully understood and objects other than those set forth above will become apparent when consideration is given to the following detailed description thereof. Such description makes reference to the annexed drawings wherein:

FIG. 1 shows schematically a steam cracking furnace with a radiant coil equipped with various enhanced radiant heat exchangers covered by the present invention;

FIGS. 2*a* and 2*b* are front and top schematic views of one possible application of the ERHE covered by the present invention.

Figure 3:
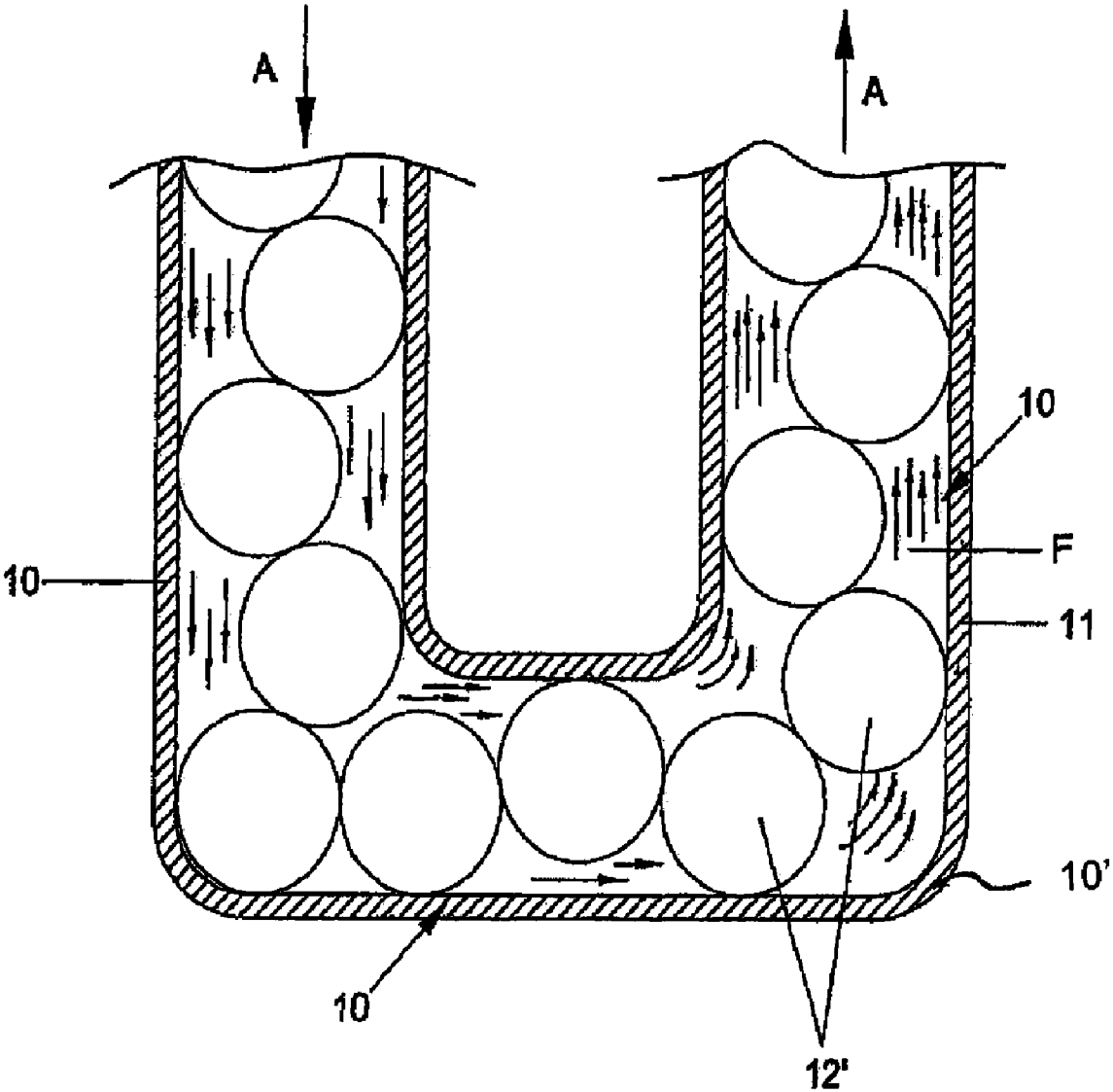

FIG. 3 shows schematically a different application of the ERHE covered by the present invention.

DETAILED DESCRIPTION OF THE PREFERRED EMBODIMENTS

The steam-cracking furnace shown in FIG. 1 has been selected to describe the benefits of using the ERHE according to the present invention.

Nevertheless, it must be clear that every heat exchanger used in a variety of process that operates at high temperatures, >400° C. for instance, can be equipped with an ERHE where the radiative energy is efficiently utilized to enhance the heat transfer as per the present invention.

Furnace 1 shows a firebox 2, the floor burners 3 and burner piping 4 for the fuel gas distribution.

Inside the firebox 2 the radiant coil 5 is installed and the fluid F flows according to the specific process requirements (heating, cracking or, in general, heat transfer).

The radiant coil 5 is connected to the convection bank 6.

In the exchanger 6, the fluid F is preheated by hot flue gas 8 leaving the firebox by way of the convection zone towards the stack B.

The radiant coil 5 consists of several enhanced heat radiant exchanger apparatuses 10, arranged in series, and is designed with the appropriate surface to absorb the thermal duty required by the process gas flowing inside.

FIGS. 2*a* and 2*b* show part of the ERHE according to the present invention.

The heat exchanger apparatus 10 according to the present invention, includes a cylindrical bore tube 11, although different shapes of tubes and configurations of the exchanger are technically possible.

Inside the tube 11 at least one body 12 is installed, which receives the radiative energy emitted by the enclosing tube 11.

The radiant coil absorbs energy (coming from the burners, the flue gas and the refractory walls) and heats the fluid F.

In the first application of the invention (FIG. 2*a* and FIG. 2*b*), the body 12 is a cylinder equipped, at the two extremities, with one up stream ogive facing the 15 the fluid flow and the other ogive 15' on the opposite, downstream end.

The aerodynamic profile of the two ogives reduces the pressure drop of the fluid flowing in the annulus at the inlet point and the outlet point of the tube 11. The reduced volume of the radiant coil leads to a reduced contact time, which allows a better selectivity (amount of high value products vs. total effluent).

The diameter and the length of the tube 16 are calculated in order to reduce the pressure drop of the EHRE, while keeping the velocity of the fluid F in the annulus at the properly required rate.

The energy generated in the firebox is, therefore, transferred to the fluid F more efficiently because:

a) The surface available for the heat transfer is increased: both the tube 11 and the body 16 are active and effective.

b) The heat transfer coefficient is improved.

The body 16 is centered inside the tube 11 in order to have a regular cross sectional area of the annulus for a well-distributed heat flux.

Such centering is carried out by means of at least one spacer 13, preferably a couple of spacers, everyone of them made of three elements disposed at 120 degrees in order to avoid irregular perturbations in the flow of the fluid.

Body 12 should preferably have supports 14 in proximity of the downstream ending edge 15'.

Inside the tube 11, several bodies 12 can moreover be installed to increase the thermal exchange throughout the entire radiant coil 5.

Several bodies 12, covered by the present invention, can eventually be installed inside the coils of already existing furnaces.

FIG. 3 illustrates simplified a further embodiment of the invention.

Instead of inserting missile shaped bodies 12 inside the tube 11, it can be filled with metallic spheres (or metallic void cylinders) or other radiative material, having a diameter larger than half of the value of the inside diameter of the tubes.

Such spheres 12 do not need any spacer or any other support. They are going to occupy the free spaces of all the tubes 10 and return bends 10'. The fluid F is forced to flow through the radiated particles of the tube packed with these spheres 12'.

Naturally, any configuration and shape of such filling elements can be used which is made of inert and radiative material able to increase the heat transfer.

Provided that the pressure drop does not increase too much.

A method for enhancing the heat transfer in process furnaces, and, in particular in the radiant coils of a steam cracking furnace, is the use of several ERHE 10 as described above in series.

While there are shown and described present preferred embodiments of the invention, it is to be distinctly understood that the invention is not limited thereto, but may be otherwise variously embodied and practiced within the scope of the following claims.

The invention claimed is:

1. A steam cracking furnace including a firebox, floor burners, and a radiant coil comprising several radiant heat exchange devices arranged in series within the firebox and wherein the radiant heat exchange devices each comprise a tube to be heated by the burners and inside the tube at least one body located inside of said tube so that fluid flowing in said tube flows around said body which is adapted to receive radiative energy emitted by the enclosing tube in which said body has the shape of a cylinder, equipped at the two ends with ogives of which one ogive is arranged at the end facing a incoming fluid and the other ogive is arranged at the opposite, downstream end, and in which said tube defines with said body an annular space for the fluid (F) to flow therethrough.

2. A steam cracking furnace including a firebox, floor burners, and a radiant coil comprising several radiant heat exchange devices arranged in series within the firebox and wherein the radiant heat exchange devices each comprise a tube to be heated by the burners and inside the tube at least one body located inside of said tube so that fluid flowing in said tube flows around said body which is adapted to receive radiative energy emitted by the enclosing tube, and wherein said body has the shape of a cylinder, equipped at its two ends with ogives of which one ogive is arranged at the end facing the incoming fluid and the other ogive is arranged at the opposite, downstream end.

3. A stream cracking furnace according to claim 2, in which said tube defines with said body an annular space for the fluid (F) to flow therethrough.

4. A steam cracking furnace according to claim 2, in which the upstream and the downstream ends of said body have a form which does not disturb the incoming fluid or the outgoing fluid (F) flowing through the annulus between said tube and said body device.

5. A steam cracking furnace according to claim 2, in which said body device is centered inside of the tube to realize an annulus of a constant width to allow a uniform heat transfer to the fluid (F).

6. A steam cracking furnace according to claim 5, in which the centered position is effected by means of at least one spacer, preferably a plurality of spacers, each consisting of three elements disposed at an angle of 120 degrees in order to avoid irregular disturbances of the fluid flow.

7. A steam cracking furnace according to claim 5, in which said body device is supported by a support, preferably in proximity of the downstream end.

8. A method of increasing the selectivity and reducing deposit of coke, creep and carbonization in a steam cracking furnace of an ethylene plant by increasing the heat transfer rate with a shorter contact time and a lower tube metal temperature, wherein the radiant coil of the furnace is heated to a temperature of 900° C. to 1175° C. and the temperature of the process gas is between 600° C. and 900° C. and the radiant coil comprises several radiant heat exchange devices each comprising a tube to be heated to the radiant coil temperature which tube is equipped inside with at least one body located inside of said tube so that fluid flowing in said tube flows around said body which is adapted to receive radiation energy from the heated tube and to transfer it by convection to the process gas flowing in the tubes, said tube defines with said body an annular space for the fluid (F) to flow therethrough, the upstream and the downstream ends of said body have a form which does not disturb the incoming fluid or the outgoing fluid (F) flowing through the annulus between said tube and said body and said body is centered inside of the tube to realize an annulus of a constant width to allow a uniform heat transfer to the fluid (F).

9. A method according to claim 8, in which the centered position is effected by means of at least one spacer, preferably a plurality of spacers, each consisting of three elements disposed at an angle of 120 degrees in order to avoid irregular disturbances of the fluid flow.

10. A method according to claim 8, in which said body is supported by a support, preferably in proximity of the downstream end.

11. A method of increasing the selectivity and reducing deposit of coke, creep and carbonization in a steam cracking furnace of an ethylene plant by increasing the heat transfer rate with a shorter contact time and a lower tube metal temperature, wherein the radiant coil of the furnace is heated to a temperature of 900° C. to 1175° C. and the temperature of the process gas is between 600° C. and 900° C. and the radiant coil comprises several radiant heat exchange devices each comprising a tube to be heated to the radiant coil temperature which tube is equipped inside with at least one body having a cylindrical shape located inside of said tube, equipped at the two ends with ogives of which one ogive is arranged at the end facing a incoming fluid and the other ogive is arranged at the opposite, downstream end so that fluid flowing in said tube flows around said body which is adapted to receive radiation energy from the heated tube and to transfer it by convection to the process gas flowing in the tube.

12. A method according to claim 11, in which said tube defines with said body an annular space for the fluid (F) to flow therethrough.

* * * * *